US008181288B1

(12) United States Patent
Davis, Jr.

(10) Patent No.: US 8,181,288 B1
(45) Date of Patent: May 22, 2012

(54) WATERPROOF BASE AND METHODS OF FABRICATION AND INSTALLATION THEREOF

(75) Inventor: Thomas A. Davis, Jr., Savannah, GA (US)

(73) Assignee: KBRS Manufacturing, Inc., Savannah, GA (US)

( * ) Notice: Subject to any disclaimer, the term of this patent is extended or adjusted under 35 U.S.C. 154(b) by 822 days.

(21) Appl. No.: 12/133,020

(22) Filed: Jun. 4, 2008

Related U.S. Application Data

(60) Provisional application No. 60/941,734, filed on Jun. 4, 2007.

(51) Int. Cl.
*A47K 3/28* (2006.01)

(52) U.S. Cl. ..... 4/613; 4/679

(58) Field of Classification Search ..... 4/613, 679; 52/34, 35

See application file for complete search history.

(56) References Cited

U.S. PATENT DOCUMENTS

| | | | | |
|---|---|---|---|---|
| 2,106,516 | A * | 1/1938 | Cheney | 4/613 |
| 2,239,969 | A * | 4/1941 | Morthland | 428/74 |
| 2,484,240 | A * | 10/1949 | Morthland | 4/613 |
| 3,134,197 | A * | 5/1964 | McColley | 52/35 |
| 3,457,568 | A * | 7/1969 | Amatruda | 4/613 |
| 3,501,879 | A | 3/1970 | Mitchell et al. | |
| 3,606,617 | A | 9/1971 | Frazier | |
| 3,675,384 | A * | 7/1972 | Knecht | 52/250 |
| 4,541,132 | A | 9/1985 | Long | |
| 4,557,004 | A | 12/1985 | Piana | |
| 5,371,980 | A * | 12/1994 | Dix | 52/34 |
| 5,778,464 | A * | 7/1998 | Chapple et al. | 4/596 |
| 5,845,347 | A * | 12/1998 | Young | 4/613 |
| 5,878,448 | A * | 3/1999 | Molter | 4/613 |
| 6,003,169 | A | 12/1999 | Davis, Jr. | |
| 6,352,760 | B1 * | 3/2002 | Fishel et al. | 428/156 |
| 6,381,775 | B1 * | 5/2002 | Sondrup | 4/679 |
| 6,571,406 | B2 * | 6/2003 | Gerloff | 4/613 |
| 6,735,793 | B2 | 5/2004 | Peterson | |
| 6,766,545 | B2 * | 7/2004 | Hodges | 4/679 |
| 6,941,703 | B2 | 9/2005 | MacLean et al. | |
| 6,990,695 | B2 | 1/2006 | Grayson | |
| 7,007,315 | B2 | 3/2006 | Stonecipher | |
| 7,100,331 | B2 * | 9/2006 | Nehring | 52/13 |
| 7,296,309 | B2 | 11/2007 | Nehring | |
| 7,472,719 | B2 * | 1/2009 | Dallmer | 137/362 |
| 7,632,401 | B2 * | 12/2009 | Edelmayer | 210/164 |
| 7,699,981 | B2 * | 4/2010 | Ledford et al. | 210/164 |
| 8,056,157 | B2 * | 11/2011 | Huang et al. | 4/613 |

(Continued)

FOREIGN PATENT DOCUMENTS

WO WO 2006086974 A1 * 8/2006

*Primary Examiner* — Basil Katcheves
*Assistant Examiner* — Rodney Mintz
(74) *Attorney, Agent, or Firm* — Gardner Groff Greenwald & Villanueva, PC

(57) ABSTRACT

A tile-ready shower basin, and methods of manufacturing and installing the same. A sloped structural core is provided having a topside and a bottom side. A first waterproof panel or coating is applied to the topside and a second waterproof panel or coating is applied to the bottom side. A thin fiberglass flange is provided about at least a portion of the perimeter of the core to create a lip. The basin further includes a first hole or recess formed into the basin, which does not extend through the basin, and a second hole, axially aligned with the first, which does extend through the basin, for directly receiving and coupling a drain therein.

11 Claims, 8 Drawing Sheets

U.S. PATENT DOCUMENTS

| | | | | |
|---|---|---|---|---|
| 8,096,093 | B1 * | 1/2012 | Poon | 52/716.2 |
| 8,112,831 | B2 * | 2/2012 | Cook | 4/613 |
| 2003/0089059 | A1 * | 5/2003 | Kirby | 52/265 |
| 2004/0034922 | A1 * | 2/2004 | Grayson | 4/613 |
| 2004/0181869 | A1 * | 9/2004 | Cowling | 4/612 |
| 2004/0187396 | A1 * | 9/2004 | Higgins | 52/58 |
| 2004/0237187 | A1 * | 12/2004 | Stonecipher | 4/613 |
| 2006/0236452 | A1 * | 10/2006 | Polimeno | 4/613 |
| 2007/0193201 | A1 * | 8/2007 | Cowling | 52/731.7 |
| 2008/0016614 | A1 | 1/2008 | Daniels | |
| 2008/0163420 | A1 * | 7/2008 | Dieter et al. | 4/613 |
| 2008/0168727 | A1 * | 7/2008 | Ledford et al. | 52/302.3 |
| 2008/0276364 | A1 * | 11/2008 | Barro et al. | 4/613 |
| 2010/0064430 | A1 * | 3/2010 | Goodson | 4/613 |
| 2010/0115865 | A1 * | 5/2010 | Donnelly et al. | 52/220.1 |
| 2010/0154112 | A1 * | 6/2010 | Goodhue | 4/613 |
| 2010/0170035 | A1 * | 7/2010 | Kik et al. | 4/613 |
| 2010/0235982 | A1 * | 9/2010 | Stimpson et al. | 4/679 |
| 2010/0281612 | A1 * | 11/2010 | Cook | 4/614 |
| 2010/0325969 | A1 * | 12/2010 | Hourihan | 52/35 |
| 2011/0197354 | A1 * | 8/2011 | Wedi | 4/613 |
| 2012/0005967 | A1 * | 1/2012 | Hourihan | 52/35 |
| 2012/0036629 | A1 * | 2/2012 | Cook | 4/613 |
| 2012/0036632 | A1 * | 2/2012 | Cook | 4/679 |

* cited by examiner

WATERPROOF BASE AND METHODS OF FABRICATION AND INSTALLATION THEREOF

CROSS-REFERENCE TO RELATED APPLICATION

This application claims the benefit of U.S. Provisional Patent Application Ser. No. 60/941,734, filed Jun. 4, 2007, which is hereby incorporated herein by reference in its entirety for all purposes.

TECHNICAL FIELD

The present invention relates generally to waterproof bases for shower stalls and the like, and more particularly to pre-made custom shower bases, and methods of fabrication and installation thereof.

BACKGROUND OF THE INVENTION

Generally, there are two types of shower stalls, pre-made and custom fabricated stalls. Custom fabricated stalls are often utilized for home renovations when it is difficult to transport large building materials through home doorways. Custom fabricated stalls are also used for installations not having a "typical" or industry standard sized shower area. These stalls are often tiled for decorative and aesthetic appeal. Typically, when constructing a custom tiled shower stall, the stall area is pre-fitted with a waterproof liner, shower pan, or other water impermeable surface to prevent water from leaking from the stall. Generally, the decorative tiles are then set in mortar over the liner to form the interior wall of the stall. However, tiled shower stalls are known to leak for a variety of reasons.

One such reason for shower stall leaks stems from damage to the waterproof shower liner or membrane. For example, a hole or tear in the liner can occur during the installation of the tile, which can require an installer to start all over in constructing the custom shower stall. Other leaks occur from damage to the shower pan or liner caused by the settling of the house. Regardless of how the leaks are born, significant damage can occur to the structure of the house as a result of the water leaks. Such damage can be costly and time consuming to correct.

Another problem with existing custom shower stalls is the difficulty in connecting the shower stall's water drain to the standard drainpipe in the floor of the house. Presently, custom-built shower basins typically utilize specialized drain plumbing to connect the two, which results in additional plumbing work, hassle, and cost.

Thus it can be seen that needs exist for improvements to custom-built shower bases to prevent water from leaking from the shower stall. It can also be seen that needs exist for shower bases that allow a direct, reliable and universal connection between the shower drain and the interior plumbing of a house.

SUMMARY OF THE INVENTION

The shower base of the present invention can be used for both residential and commercial tile shower applications. The shower base can be used in place of typical known sloped liner and mortar tile shower bases. Each shower base can be manufactured to the exact specifications of a user's shower stall area as determined by a user or installer, including the location of the user's drain. The shower base is manufactured via a process by which the base has a substantially greater waterproofing ability than with known shower bases.

In example forms, the present invention is a method of creating a custom or standard size ready-to-tile shower basin, which preferably includes the following steps. First, a structural core formed of EPS (Expanded Polystyrene), honeycomb, or other shapeable core material, having a topside and a bottom side, is cut to the specified size and shape. Second the core is sloped to the specified drain location. Third, a panel or skin is applied to the bottom area around the drain. Fourth, fiberglass mesh and epoxy resin is applied to the topside creating a shower base "blank". Fifth, the shower base blank is cut to final size according to the specifications. Sixth, a substantially vertically oriented thin rigid flange and/or curb is applied to the perimeter of the core along one or more sides thereof, using an elastomeric epoxy, to create a waterproof barrier. Seventh, all seams, where the rigid perimeter flange meets the core, are sealed using a waterproof tape. Finally, an elastomeric waterproofing material is applied to all surface areas of the finished structure of the custom or standard size shower base. The basin includes a larger diameter first hole or recess on the top side formed into the basin's core. It also includes a smaller diameter second hole co-axially aligned with the first, which extends through the panel/skin attached to the bottom drain area. The second hole allows a standard tile drain's bolts to protrude upward through the bottom panel/skin into the recessed core area when the shower base is lowered into place over the tile drain "body". The tile drain's "clamping ring" is lowered into the first hole recessed area of the core, and attached to the tile drain's bolts from the topside of the shower base, thus "clamping" the shower base to the drain body in the sub-floor.

In one aspect, the invention is a waterproof base providing connection between a tile drain and a drainpipe. The shower base preferably includes an expanded polymer core defining a top surface and a bottom surface, the top surface sloping toward a drain opening extending through the polymer core from the top surface to the bottom surface, and further including a drain receiving recess in the top surface and extending at least partially through the expanded polymer core surrounding the drain opening. The shower base preferably also includes a waterproof top layer applied over the top surface of the expanded polymer core, and a bottom skin applied to the bottom surface of the expanded polymer core at least around the drain opening.

In another aspect, the invention is a method of fabricating a shower base. The method preferably includes the step of forming an expanded polymer core to define a top surface and a bottom surface, the top surface sloping toward a drain opening extending through the polymer core from the top surface to the bottom surface, and further including a drain receiving recess in the top surface and extending at least partially through the expanded polymer core surrounding the drain opening. The method preferably also includes applying a waterproof top layer over the top surface of the expanded polymer core, and applying a bottom skin to the bottom surface of the expanded polymer core at least around the drain opening.

In still another aspect, the invention is a method of installing a waterproof base. The method preferably includes the step of providing an assembly comprising an expanded polymer core defining a top surface and a bottom surface, the top surface sloping toward a drain opening extending through the polymer core from the top surface to the bottom surface, and further including a drain receiving recess in the top surface and extending at least partially through the expanded polymer core surrounding the drain opening. The drain receiving recess preferably defines an annular surface directed toward the top surface to define an upper drain clamping surface. The assembly preferably further includes a waterproof top layer applied over the top surface of the expanded polymer core, and a bottom skin applied to the bottom surface of the expanded polymer core at least around the drain opening. The method preferably further includes placement of the assembly onto a substrate, with the drain opening aligned with a lower drain element in the substrate, and attaching an upper drain element against the drain clamping surface of the drain receiving recess of the assembly and in engagement with the lower drain element.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1A:
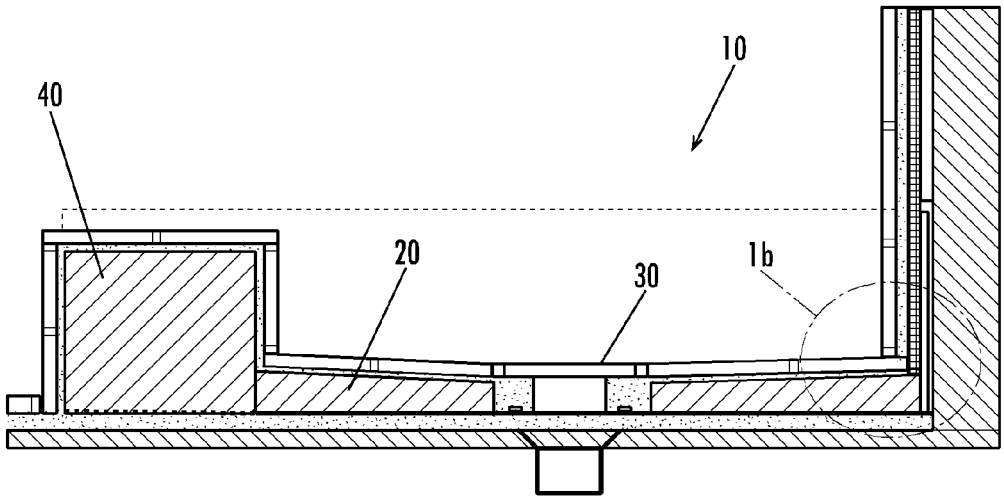
FIG. 1*a* is a side view of a shower base, shown with optional curb, according to an example embodiment of the present invention.
Figure 1B:
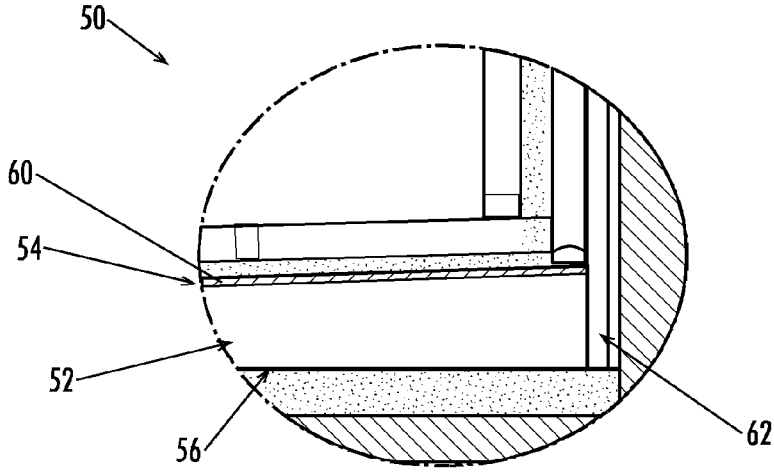
FIG. 1*b* is a close up view of the several layers comprising the shower base of FIG. 1*a*.
Figure 2:
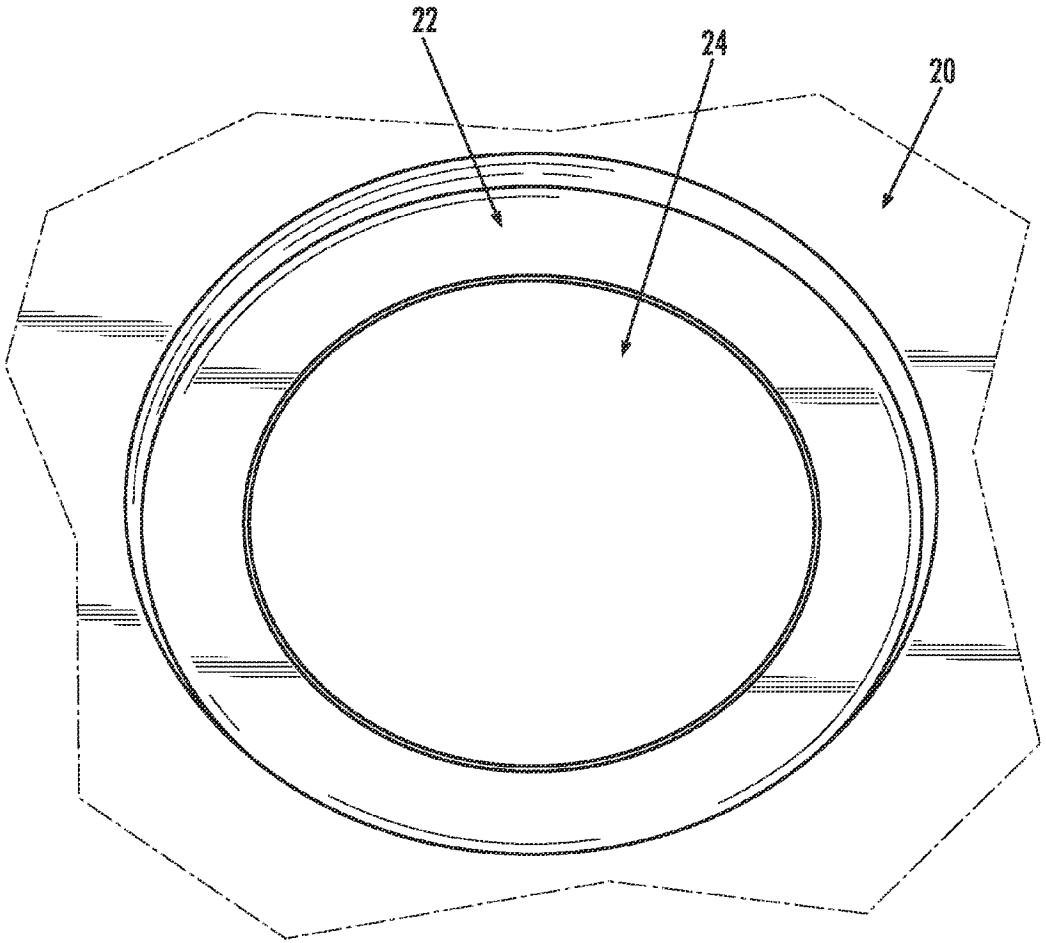
FIG. 2 is a perspective view of the drain hole of the shower base of FIG. 1.
Figure 3:
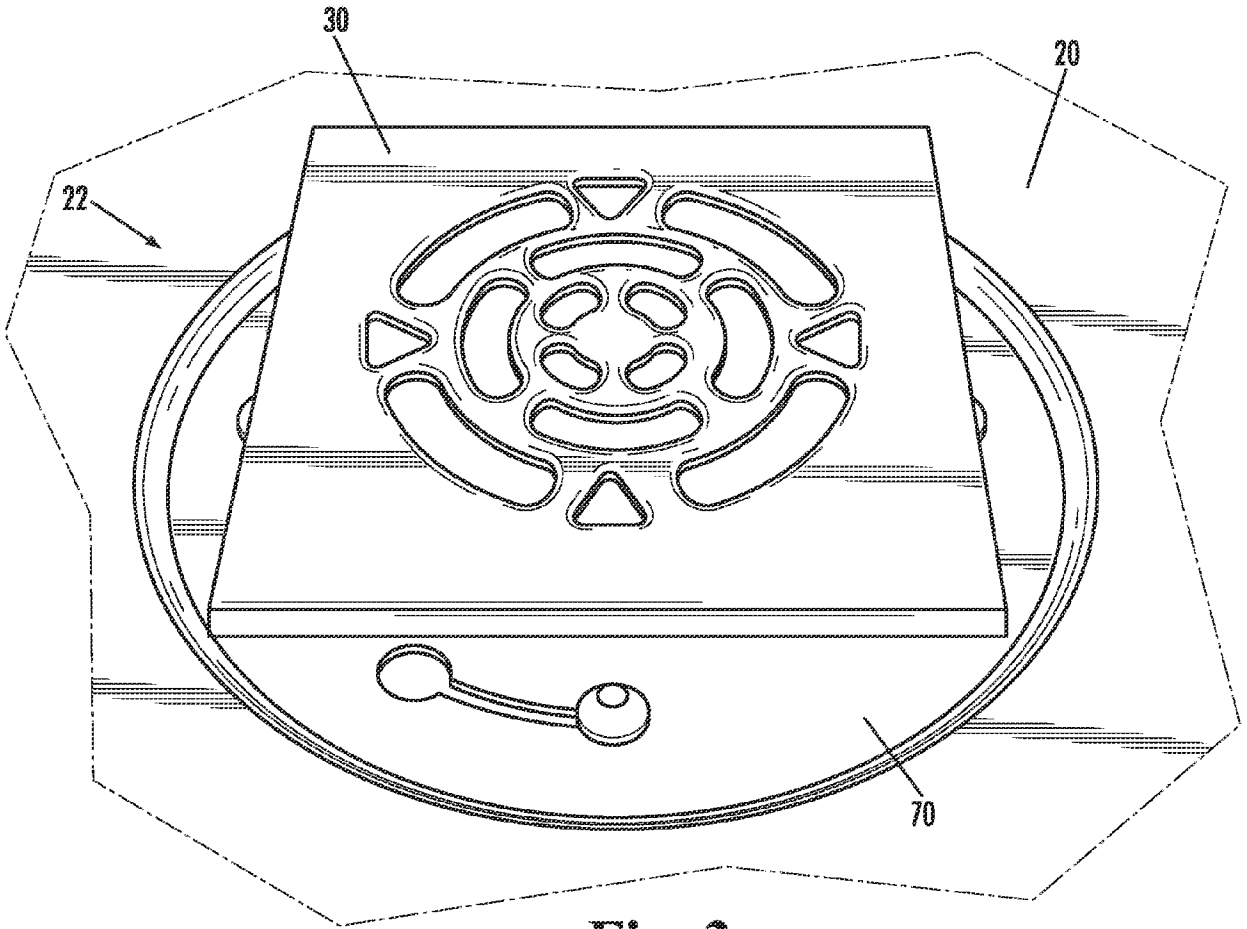
FIG. 3 is a perspective view of the drain hole of FIG. 2, shown with a shower drain mounted therein.
Figure 4:
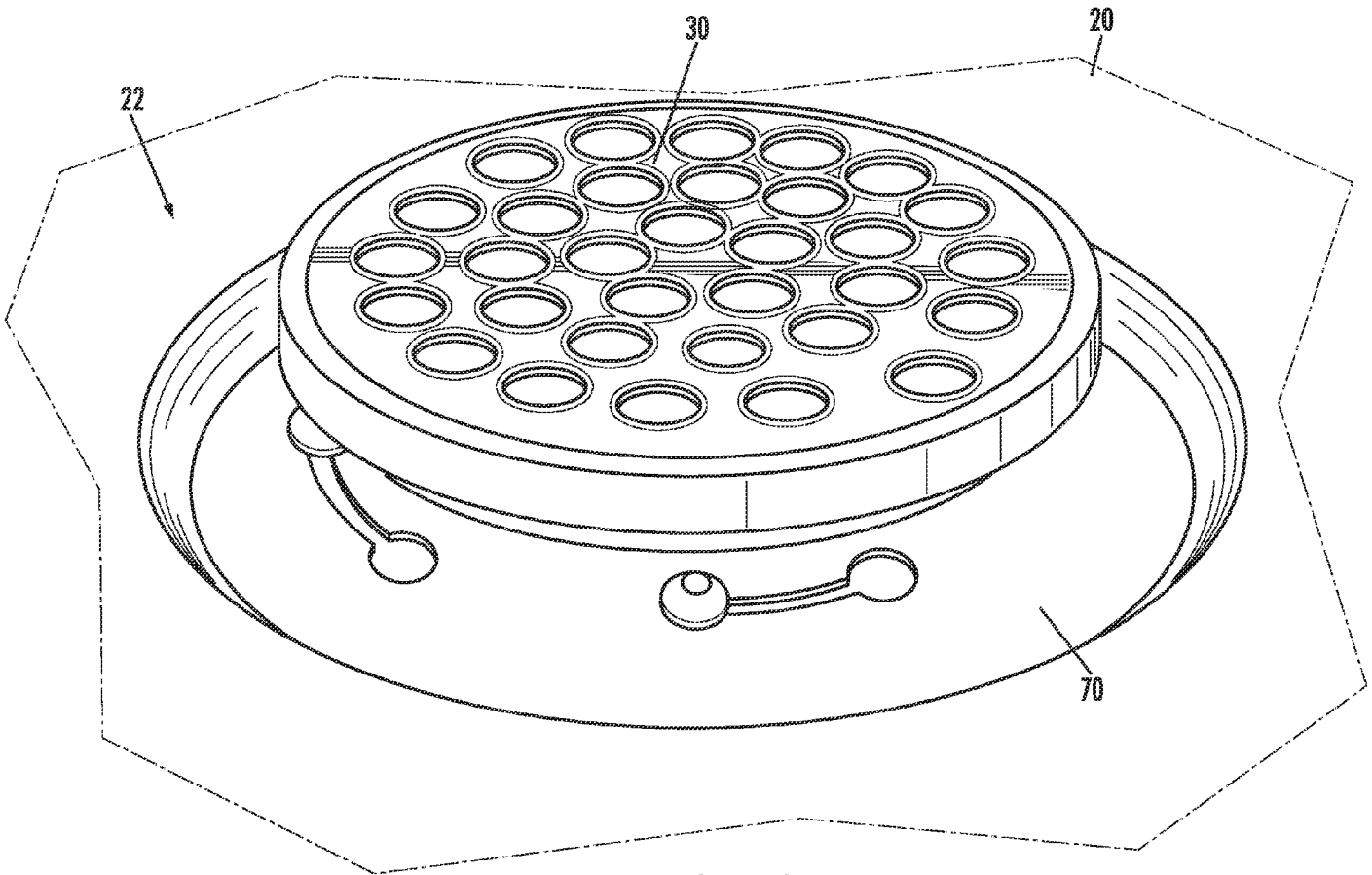
FIG. 4 is a perspective view of the drain hole of FIG. 2, shown with another shower drain mounted therein.
Figure 5B:
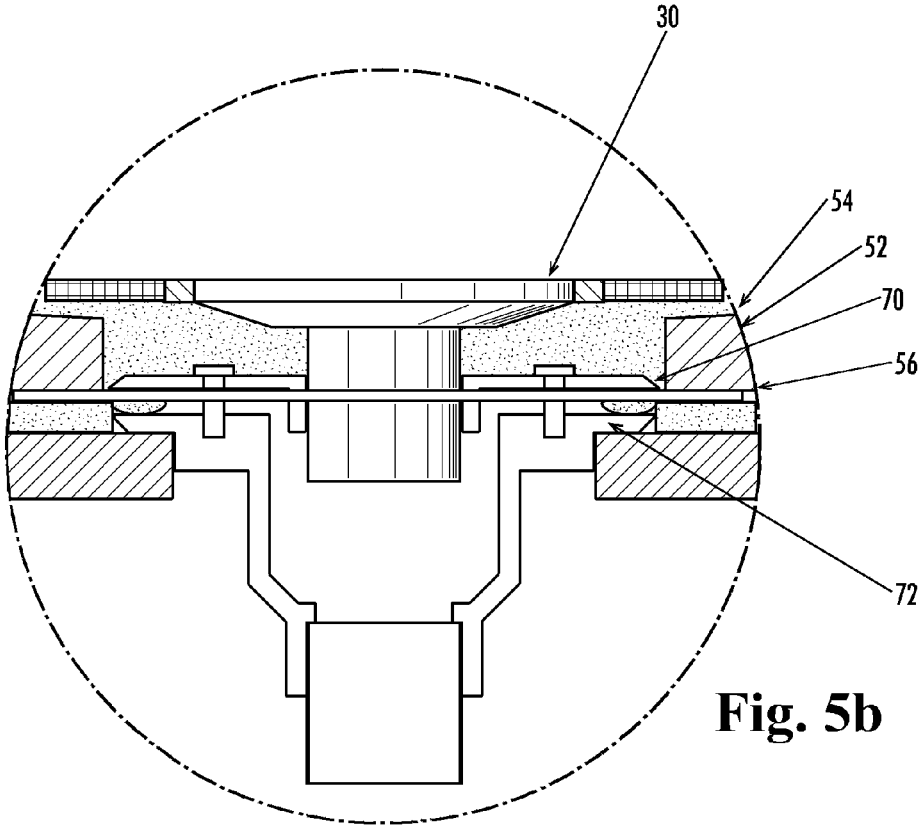
FIG. 5*b* is a close up view of the drain connection area of FIG. 5*a*.
Figure 5A:
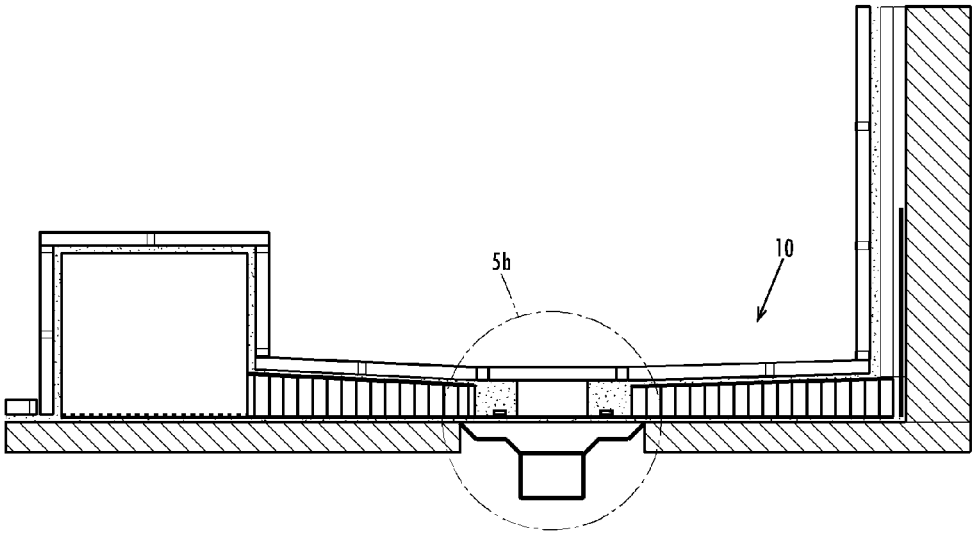
FIG. 5*a* is a side view showing further detail of the drain connection for the shower base of FIG. 1.
Figure 6:
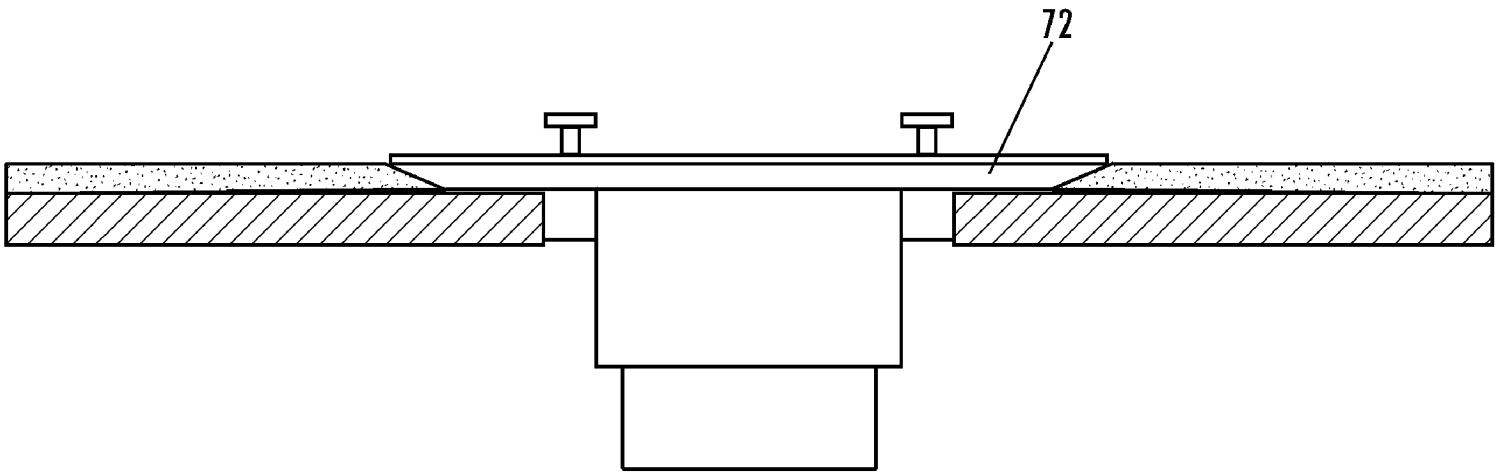
FIGS. 6, 7*a*-7*e*, and 8 show a sequence of installation of the shower base according to an example form of the present invention.
Figure 7A:
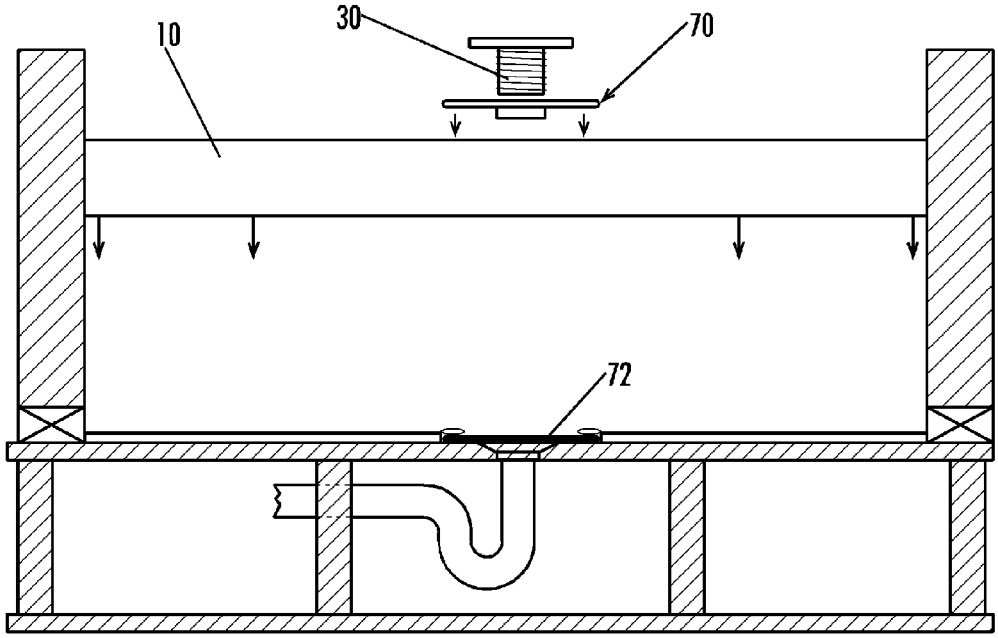
Figure 7B:
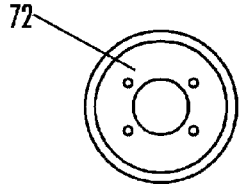
Figure 7C:
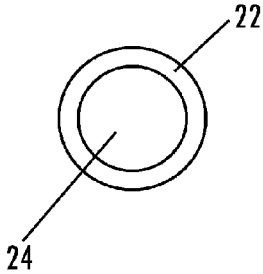
Figure 7D:
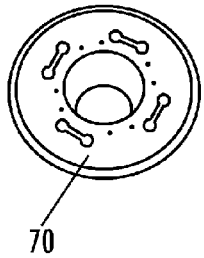
Figure 7E:
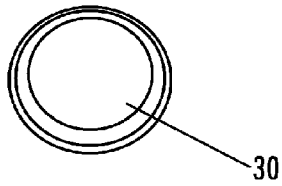
Figure 8:
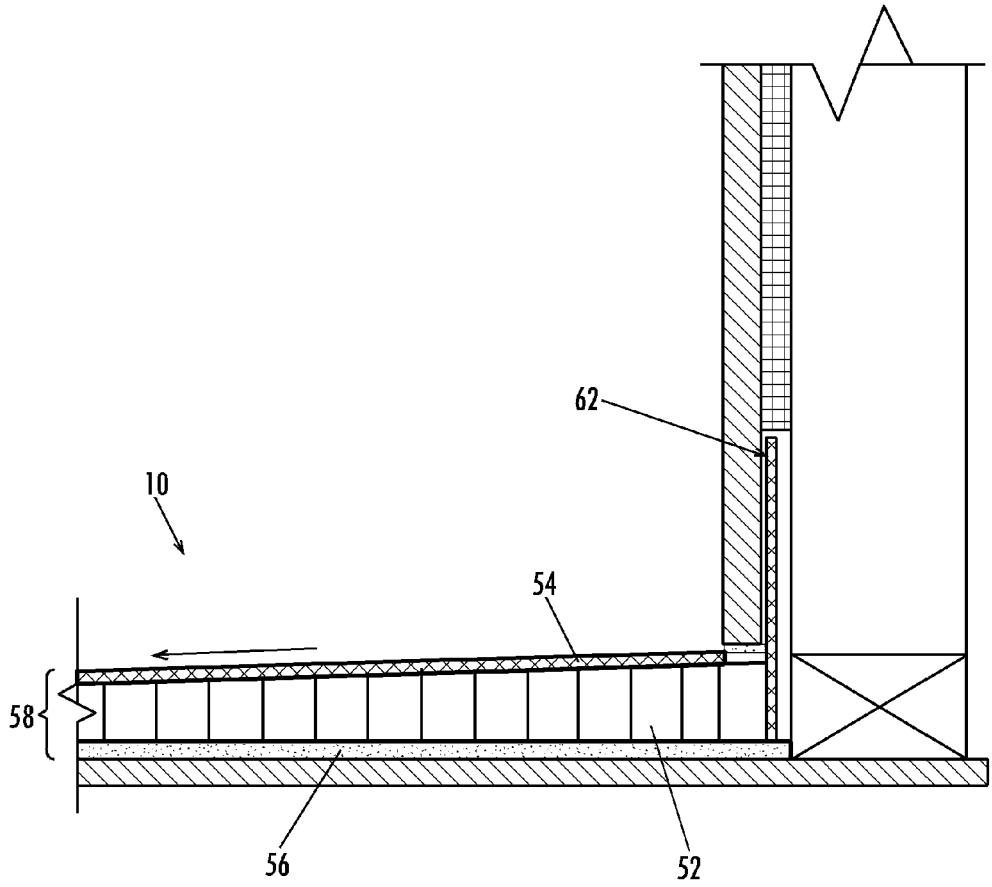

With reference now to the drawing figures, FIGS. 1*a* and 1*b* show a "tile-ready" shower base 10 according to an example embodiment of the present invention. The shower base 10 of the present invention can be used for both residential and commercial tile shower applications. The shower base 10 can be used in place of typical known sloped liner and mortar tile shower bases. Each shower base 10 can be custom manufactured to the exact specifications of a user's shower stall area as determined by a user or installer, including the location of the user's drain, or can be fabricated in one or more standard size formats. The shower base 10 is manufactured via a fabrication process and installed via an installation process, each discussed herein, by which the base has a substantially greater waterproofing ability than previously known shower bases. Generally, the shower base 10 comprises a sloped basin 20, at least one drain 30, and optionally a raised curb 40.

The shower basin 20 is fabricated as an assembly 50 of multiple layers, as shown in greater detail in FIG. 1A, which are coupled together into a unitary component through a unique manufacturing process that creates an exceptionally strong and long lasting waterproof surface. The assembly is preferably factory-fabricated, and delivered to a remote installation site for installation. When fully constructed, the basin has a graded slope towards the drain 30. It is preferred that the minimum amount of slope is about 0.25 inches/foot, but other slopes can be utilized as desired by a user.

In example embodiments, a core layer 52 of the basin 20 is formed from expanded polystyrene foam, polypropylene structural honeycomb thermoplastic, foam, rubber, plastics, wood, metals, or other solid or porous formable structural material(s). The core 52 is contoured to accommodate the desired slope of the basin. The core 52 is sandwiched between two waterproof panels or sheets 54, 56 of acrylic, thermoplastic, or other waterproof panel materials such as for example, PLAS-TEX® (manufactured by Parkland Plastics), CORIAN®, or POLYCOMP®. In an example embodiment, the waterproof top layer is a fiberglass mesh and epoxy resin top coat 54, and the waterproof bottom layer is a waterproof skin applied around the drain area. An adhesive such as for example, GORILLA GLUE®, is preferably applied between the waterproof panels 54, 56 and the core 52; and a membrane press, or other pressure applying method or apparatus, can be used to press the panels and core together. The assembly resulting from the combination of the waterproof panels 54, 56 and the core 52 is referred to as the sloped sandwiched blank ("SSB") 58.

Once the SSB 58 is completed, a layer of crack isolation material 60 is optionally applied to the sloped (top) surface of the SSB to prevent and/or contain any cracks that may develop in the SSB 58. In example embodiments, the crack isolation material 60 comprises a polyester, such as the material sold under the tradename FLEX-GUARD®. The crack isolation material 60 allows for expansion and contraction between the SSB 58 and the material (typically tile) applied over the SSB.

After application of the crack isolation material 60, the SSB 58 receives a fiberglass/PLAS-TEX® flange 62 that surrounds the perimeter of the SSB. In example embodiments, the flange 62 is about 5 inches in height, but the height of the flange can vary as desired. It is preferred that the flange 62 be secured to the SSB 58 with silicone adhesive, although other types of adhesives can be applied. After the flange 62 has been secured to the SSB 58, the exterior of the basin 20 is encapsulated with fiberglass cloth and saturated with polyester fiberglass resin. Optionally, a bead joint of adhesive is applied to the joint between the flange 62 and SSB 58 for further waterproofing. The flange 62 is preferably thin, for example about 0.25" or less, to permit the shower's tile wall backerboard to extend over the flange to the sloped top surface of the shower base, for leak prevention and ease of installation. Once installed in the appropriate location, the basin 20 is ready to receive tile.

Optionally, a curb 40 is applied to the basin 20, as seen in FIG. 1. Typically, the curb 40 is positioned along the length of the entry point for a user to enter the basin area, although it can be positioned along two or more sides of the basin. In commercial embodiments utilizing a curb 40, it is preferred that the curb be about 4 inches in width by 4 inches in height, wherein the curb replaces the flange 62 in areas that it is applied. However, in other embodiments, the dimensions of the curb 40 can vary as desired. The curb 40 is manufactured in a similar process as the basin 20, except that the curb typically includes a much thicker core, as seen in the drawing figures.

The basin 20 includes a first drain hole or recess 22 in the top surface of the basin to receive a standard tile drain 30 during installation, as seen in FIGS. 2-7. In example embodiments, the drain recess 22 is about six inches in diameter, although the diameter of the recess can vary as desired or needed to accommodate a particular drain 30. The recess 22 preferably extends from the top surface of the basin 20 through the top waterproof layer 54 and at least partially through the EPS core 52, but not through the bottom waterproof layer or skin 56. A second drain hole 24 is axially aligned with the first hole or drain recess 22 and extends through the SSB 58 in its entirety, including through the bottom waterproof layer or skin 56. The second drain hole 24 is preferably about four inches in diameter, but can vary depending on the application. The recess and drain hole 22, 24 allow a clamping attachment mechanism 70 of a standard tile drain 30 to be used to couple the basin 20 to a drain body 72 installed in the sub-floor and connected to a standard interior or exterior plumbing drainpipe, as depicted in FIGS. 3-7*e*.

The shower base 10 is installed by cleaning and removing any debris from the sub-floor in the area that the shower base is to be installed. Latex modified thin-set mortar is applied to the substrate using a square or U-notched trowel (thin-set should be flush with the top edge of the drain body flange). A bead of 100% silicone adhesive is applied around the outside perimeter area of the tile drain body 72 (see FIG. 7*b*). The shower base 10 is lowered into place, and the shower base is solidly embedded in the mortar, and leveled to insure proper drainage. Drain bolts are replaced, the clamping ring 70 installed, and the drain clamp bolts tightened to engage the bottom skin 56 of the shower base in the area of the recess 22. The drain top 30 is adjusted to the desired height, and latex modified thin-set is troweled into the area around the clamping ring 70. The shower base 10 is then ready to be tiled according to typical fashion. Because the basin 20 is directly coupled to the drain body 72, a watertight seal can readily be relied upon without the need for additional plumbing work, which is typically necessary with pre-made shower bases. Additionally, the shower base of the present invention enables use of a standard tile drain, without need for specialized parts or modification.

The present invention therefore includes a tile-ready shower base apparatus 10 that does not have many of the problems typically associated with a tiled shower basin, a method of manufacturing or fabricating such an apparatus, and a method of installing such an apparatus.

While the invention has been described with reference to preferred and example embodiments, it will be understood by those skilled in the art that a variety of modifications, additions and deletions are within the scope of the invention, as defined by the following claims.

What is claimed is:

1. A waterproof base providing connection between a tile drain and a drainpipe, the waterproof base comprising:

an expanded polymer core defining a top surface and a bottom surface, the top surface sloping toward a drain opening extending through the polymer core from the top surface to the bottom surface, and further comprising a drain receiving recess in the top surface and extending at least partially through the expanded polymer core surrounding the drain opening;

a waterproof top layer applied over the top surface of the expanded polymer core;

a bottom skin applied to the bottom surface of the expanded polymer core at least around the drain opening;

a rigid upright flange, the rigid upright flange projecting upwardly from the bottom skin and extending above the top surface of the expanded polymer core about at least a portion of the periphery of the expanded polymer core, the rigid upright flange directly abutting and surrounding at least a portion of the periphery of the expanded polymer core, and the rigid upright flange having a thickness of no more than 0.25 inches; and an adjustable drain top having an upper drain flange for mounting over the drain receiving recess in the top surface of the expanded polymer core, and a drain conduit extending through the drain opening through the expanded polymer core for engagement with a drain clamp mounted to the drainpipe.

2. The waterproof base of claim 1, wherein the waterproof top layer comprises a fiberglass mesh and epoxy resin.

3. The waterproof base of claim 1, further comprising an elastomeric waterproofing layer applied to at least a portion of the base's exposed exterior surfaces.

4. The waterproof base of claim 1, wherein drain receiving recess defines an annular surface directed toward the top surface forming a clamping surface for engagement with a portion of the tile drain.

5. The waterproof base of claim 1, further comprising a curb along at least one side of the expanded polymer core.

6. A waterproof shower base comprising:

an expanded polymer core defining a top surface and a bottom surface, the top surface sloping toward a drain opening extending through the polymer core from the top surface to the bottom surface, and further comprising a drain receiving recess in the top surface surrounding the drain opening, the drain receiving recess being configured to receive a standard tile drain;

a waterproof top layer applied over the top surface of the expanded polymer core;

a bottom skin applied to the bottom surface of the expanded polymer core at least around the drain opening;

a rigid upright flange, the rigid upright flange projecting upwardly from the bottom skin and extending above the top surface of the expanded polymer core about at least a portion of the periphery of the expanded polymer core, the rigid upright flange directly abutting and surrounding at least a portion of the periphery of the expanded polymer core, and the rigid upright flange having a thickness of no more than 0.25 inches; and a drain assembly comprising a drain clamp for attachment to an underlying drain body, and an adjustable drain top having an upper drain flange and a drain conduit, wherein the upper drain flange is installed over the drain receiving recess in the top surface of the expanded polymer core and grouted in place, and wherein the drain conduit extends through the drain opening of the expanded polymer core and into the drain clamp.

7. A method of fabricating a shower base, said method comprising:

forming an expanded polymer core to define a top surface and a bottom surface, the top surface sloping toward a drain opening extending through the polymer core from the top surface to the bottom surface, and further comprising a drain receiving recess in the top surface and extending at least partially through the expanded polymer core surrounding the drain opening;

applying a waterproof top layer over the top surface of the expanded polymer core;

applying a bottom skin to the bottom surface of the expanded polymer core at least around the drain opening;

attaching a rigid upright flange, the rigid upright flange projecting upwardly from the bottom skin and extending above the top surface of the expanded polymer core about at least a portion of the periphery of the expanded polymer core, the rigid upright flange directly abutting and surrounding at least a portion of the periphery of the expanded polymer core, and the rigid upright flange having a thickness of no more than 0.25 inches;

installing a drain clamp to a drain body connected to a drain pipe;

installing an adjustable drain top having an upper drain flange and a drain conduit, wherein the upper drain flange is mounted over the drain receiving recess in the top surface of the expanded polymer core and the drain conduit extends through the drain opening through the expanded polymer core and through the drain clamp into fluid communication with the drain pipe;

adjusting the height of the upper drain flange of the adjustable drain top; and applying a thin-set grout within the drain receiving recess in the top surface of the expanded polymer core and around the drain conduit of the adjustable drain top.

8. The fabrication method of claim 7, wherein the step of applying a waterproof top layer comprises applying a fiberglass mesh and epoxy resin to the top surface of the expanded polymer core.

9. The fabrication method of claim 7, further comprising applying an elastomeric waterproofing layer to at least a portion of the shower base's exposed exterior surfaces.

10. The fabrication method of claim 7, further comprising forming an annular surface of the drain receiving recess directed toward the top surface to define a drain clamping surface.

11. The fabrication method of claim 7, further comprising installing a curb along at least one side of the expanded polymer core.

* * * * *